United States Patent [19]

Jewett

[11] 4,296,916

[45] Oct. 27, 1981

[54] SUBMERSIBLE PUMP PULLER

[76] Inventor: M. Pearson Jewett, P.O. Box 442, Rockland, Me. 04841

[21] Appl. No.: 97,526

[22] Filed: Nov. 26, 1979

[51] Int. Cl.[3] ..... B66D 3/00

[52] U.S. Cl. ..... 254/380; 248/219.2; 248/231.1; 254/224

[58] Field of Search ..... 254/380, 342, 343, 224, 254/219, 266; 248/219.2, 231.1, 226.3, 226.4, 226.5, 226.2; 242/106; 166/335, 368, 362

[56] References Cited

U.S. PATENT DOCUMENTS

| | | | |
|---|---|---|---|
| 1,204,277 | 11/1916 | Kasprzyk | 254/224 |
| 1,403,962 | 1/1922 | Jolly | 254/380 |
| 2,619,308 | 11/1952 | Guestinger | 248/226.3 |
| 3,718,317 | 2/1973 | Hilmer | 254/380 |
| 3,741,525 | 6/1973 | Smedley | 254/266 |
| 3,991,978 | 11/1976 | Jones | 248/219.2 |

*Primary Examiner*—Billy S. Taylor
*Attorney, Agent, or Firm*—W. R. Hulbert

[57] ABSTRACT

A device for pulling a submersible pump from a well casing comprises a pair of spaced, parallel legs adapted to straddle the rim of the casing and be clamped thereto by upper and lower clamps. A submersible pump in the well may be pulled by operating a winch mounted at the upper end of the device.

2 Claims, 3 Drawing Figures

SUBMERSIBLE PUMP PULLER

BACKGROUND OF THE INVENTION

There has long existed a need for a simple, portable device, operable by one man, to pull submersible deep well pumps from the wells to permit servicing, repair, or replacement. Such a pump, when installed, is suspended from the end of cable permitting the pump to be lowered into the casing to the bottom of a deep water well and later pulled up for servicing. Conventional procedures usually require more than one man and the use of expensive hoisting equipment which is moved to a position over the well.

SHORT STATEMENT OF THE INVENTION

The invention provides an inexpensive, light-weight and portable device for pulling a submersible pump from a well which can be transported, set up and operated by one man.

In accordance with the invention I provide a device for pulling a submersible pump suspended by a cable in a well casing which comprises a pair of spaced, parallel legs, means for clamping the legs to each other at their upper ends, means for clamping the legs to each other and to the casing wall at a location between their ends, and a winch mounted at the upper end of the legs. Thereby the device may be clamped by the clamping means over the rim of the open end of a well casing with one leg on the inside and the other leg on the outside of the casing so that a submersible pump in the well may be pulled by means of its cable by operating the winch. In a preferred embodiment one leg is shorter than the other and the second named clamping means is located near the lower end of the shorter leg, the device being adapted to be mounted with the longer leg inside the casing and the shorter leg clamped to the outside of the casing to improve its stability; the clamping means comprise carriage bolts and wing nuts and the winch is mounted at the upper end of the longer rail and is held thereto in part by the first named clamping means.

DETAILED DESCRIPTION OF PREFERRED EMBODIMENT

Figure 1:
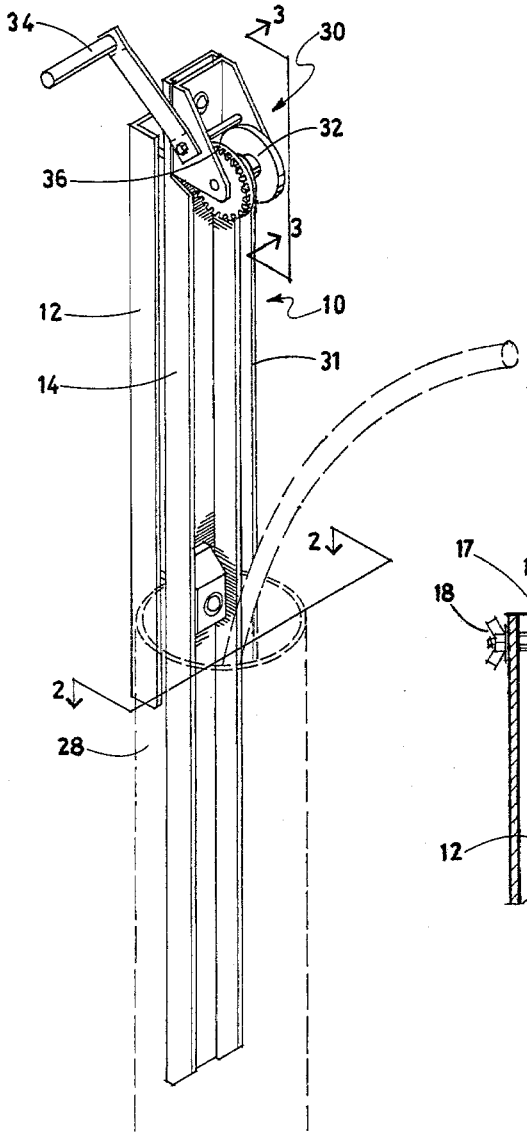
FIG. 1 is a view in perspective of the novel pump puller mounted on the lip of a well casing (shown in broken lines) pulling a submersible pump.
Figure 2:
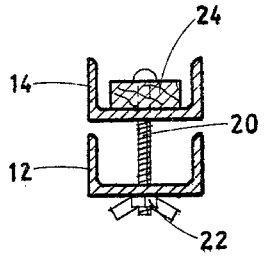
FIG. 2 is a cross-section taken on line 2—2 of FIG. 1.
Figure 3:
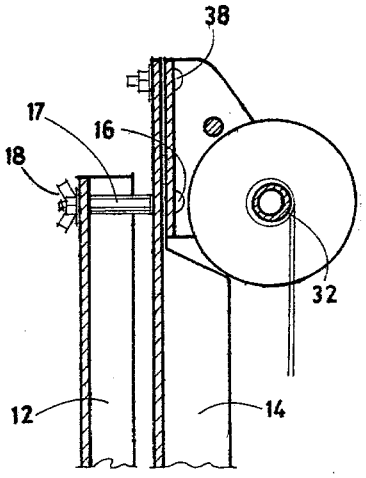
FIG. 3 is a cross-section taken on line 3—3 of FIG. 1.

The device is indicated generally by the numeral 10. It comprises a pair of legs in the form of channel irons or rails 12, 14 preferably of aluminum, one of which 14, is longer than the other. The two are held together appropriately spaced from each at their upper ends by carriage bolt 16, spacer 17 and wing nut 18. At a point a short distance above the lower end of channel iron 12, the two irons are provided with clamping means for clamping them onto the rim of a well casing. Such means comprises bolt 20, wing nut 22, and wooden block 24. The bolt passes through openings in the two legs and when the legs are astraddle the rim of casing 28 the device may be firmly clamped in place by securely tightening the two wing nuts.

At the upper end of leg 14 is mounted a conventional winch 30, which may be of the type used on boat trailers. The pump cable 31 is attached to the winch and the pump is hauled by winding the cable onto the winch drum 32. The winch includes conventional handle 34 and gearing 36 to provide the necessary mechanical advantage. The winch 30 is mounted on the leg 14 by means of carriage bolt 38 and bolt 16.

Operation

In use, the device is brought to the well site and mounted with its legs 12, 14 straddling the edge of the well casing from which the cover has been removed. The longer leg extends down the interior of the casing and the short leg down the exterior. The two wing nuts 18, 22 are tightened so that the legs are securely clamped to the casing. The cable suspending the pump is then made fast to the winch drum and the winch operated to haul the pump and its tubing out of the well. The entire operation may be accomplished by one man working alone.

While a presently preferred embodiment of the invention is shown and described, it is intended that the scope of the invention be limited only by the proper scope to be afforded the appended claims.

I claim:

1. A device for pulling a submersible pump from a well casing in which it is suspended by a cable, said device comprising a pair of rails, one of which is longer than the other;

a threaded bolt, spacer and wing-nut assembly connecting the upper end of the shorter rail to the longer rail at a point spaced below the upper end of the latter so that said rails are adjustably held in parallel spaced relation with portions of the longer rail protruding both above and below the corresponding ends of the shorter rail;

a second threaded bolt and wing-nut assembly interconnecting said rails at a location spaced both from said first assembly and from the lower end of said shorter rail, and a winch mounted on the upwardly protruding portion of said longer rail, whereby said device may be clamped to the rim of a well casing by tightening said wing-nut assemblies with said longer leg extending inside the casing and a portion of said shorter leg extending downwardly outside said casing so that said winch is suspended over the casing in position to pull a submerged pump by means of said cable.

2. The device as claimed in claim 1 wherein said winch is mounted in part by means of said first named bolt and wing-nut assembly.

* * * * *